US007618468B2

(12) United States Patent
Huff, Jr. et al.

(10) Patent No.: US 7,618,468 B2
(45) **Date of Patent: *Nov. 17, 2009**

(54) TRANSPORTATION FUELS

(75) Inventors: George A. Huff, Jr., Naperville, IL (US); William H. Gong, Elmhurst, IL (US); Leslie R. Wolf, Naperville, IL (US); John C. Eckstrom, Elburn, IL (US); Douglas N. Rundell, Glen Ellyn, IL (US); Michael Hodges, Wonersh (GB); Monica Cristina Regalbuto, Glenview, IL (US)

(73) Assignee: BP Corporation North America Inc., Warrenville, IL (US)

( * ) Notice: Subject to any disclaimer, the term of this patent is extended or adjusted under 35 U.S.C. 154(b) by 855 days.

This patent is subject to a terminal disclaimer.

(21) Appl. No.: 11/081,062

(22) Filed: Mar. 15, 2005

(65) Prior Publication Data

US 2005/0178050 A1 Aug. 18, 2005

Related U.S. Application Data

(62) Division of application No. 09/779,288, filed on Feb. 8, 2001, now Pat. No. 6,872,231.

(51) Int. Cl.
*C10L 1/18* (2006.01)

(52) U.S. Cl. ..... 44/437; 44/393; 44/441; 44/451

(58) Field of Classification Search ..... 44/441, 44/442, 393, 436, 437, 451
See application file for complete search history.

(56) References Cited

U.S. PATENT DOCUMENTS 6,872,231 B2 * 3/2005 Huff et al. ..... 44/436

* cited by examiner

*Primary Examiner*—Cephia D Toomer
(74) *Attorney, Agent, or Firm*—Ekkehard Schoettle

(57) ABSTRACT

The present invention relates to Compositions of fuels for transportation are disclosed, particularly organic compositions which are liquid at ambient conditions. More specifically, it relates to transportation fuels comprising suitable organic distillates, as a predominant component, and limited, but essential, amounts of a component comprising oxygen-containing organic materials, which materials are typically derived from natural petroleum. Beneficially, the oxygen content of these transportation fuels is at least 0.02 percent by weight. Preferably the oxygen content these transportation fuels is in a range from about 0.2 percent to about 10 percent by weight.

6 Claims, No Drawings

TRANSPORTATION FUELS

This is a division of application Ser. No. 09/779,288 now U.S. Pat. No. 6,872,231, filed Feb. 8, 2001.

TECHNICAL FIELD

The present invention relates to compositions of fuels for transportation, particularly organic compositions which are liquid at ambient conditions. More specifically, it relates to transportation fuels comprising suitable organic distillates, as a predominant component, and limited, but essential, amounts of a component comprising oxygen-containing organic materials, which materials are typically derived from natural petroleum. Beneficially, the oxygen content of these transportation fuels is at least 0.02 percent by weight.

BACKGROUND OF THE INVENTION

It is well known that internal combustion engines have revolutionized transportation following their invention during the last decades of the 19th century. While others, including Benz and Gottleib Wilhelm Daimler, invented and developed engines using electric ignition of fuel such as gasoline, Rudolf C. K. Diesel invented and built the engine named for him which employs compression for auto-ignition of the fuel in order to utilize low-cost organic fuels. Development of improved diesel engines for use in transportation has proceeded hand-in-hand with improvements in diesel fuel compositions. Modern high performance diesel engines demand ever more advanced specification of fuel compositions, but cost remains an important consideration.

At the present time most fuels for transportation are derived from natural petroleum. Indeed, petroleum as yet is the world's main source of hydrocarbons used as fuel and petrochemical feedstock. While compositions of natural petroleum or crude oils are significantly varied, all crudes contain sulfur compounds and most contain nitrogen compounds which may also contain oxygen, but the oxygen content of most crudes is low. Generally, sulfur concentration in crude is less than about 8 percent, with most crudes having sulfur concentrations in the range from about 0.5 to about 1.5 percent. Nitrogen concentration is usually less than 0.2 percent, but it may be as high as 1.6 percent.

Crude oil seldom is used in the form produced at the well, but is converted in oil refineries into a wide range of fuels and petrochemical feedstocks. Typically fuels for transportation are produced by processing and blending of distilled fractions from the crude to meet the particular end use specifications. Because most of the crudes available today in large quantity are high is sulfur, the distilled fractions must be desulfurized to yield products which meet performance specifications and/or environmental standards. Sulfur containing organic compounds in fuels continue to be a major source of environmental pollution. During combustion they are converted to sulfur oxides which, in turn, give rise to sulfur oxyacids and, also, contribute to particulate emissions.

Even in newer, high performance diesel engines combustion of conventional fuel produces smoke in the exhaust. Oxygenated compounds and compounds containing few or no carbon-to-carbon chemical bonds, such as methanol and dimethyl ether, are known to reduce smoke and engine exhaust emissions. However, most such compounds have high vapor pressure and/or are nearly insoluble in diesel fuel, and they have poor ignition quality, as indicated by their cetane numbers. Furthermore, other methods of improving diesel fuels by chemical hydrogenation to reduce their sulfur and aromatics contents, also causes a reduction in fuel lubricity. Diesel fuels of low lubricity may cause excessive wear of fuel injectors and other moving parts which come in contact with the fuel under high pressures.

Distilled fractions used for fuel or a blending component of fuel for use in compression ignition internal combustion engines (Diesel engines) are middle distillates that usually contain from about 1 to 3 percent by weight sulfur. In the past a typical specifications for Diesel fuel was a maximum of 0.5 percent by weight. By 1993 legislation in Europe and United States limited sulfur in Diesel fuel to 0.3 weight percent. By 1996 in Europe and United States, and 1997 in Japan, maximum sulfur in Diesel fuel was reduced to no more than 0.05 weight percent. This world-wide trend must be expected to continue to even lower levels for sulfur.

In one aspect, pending introduction of new emission regulations in California and Federal markets has prompted significant interest in catalytic exhaust treatment. Challenges of applying catalytic emission control for the diesel engine, particularly the heavy-duty diesel engine, are significantly different from the spark ignition internal combustion engine (gasoline engine) due to two factors. First, the conventional TWC catalyst is ineffective in removing NOx emissions from diesel engines, and second, the need for particulate control is significantly higher than with the gasoline engine.

Several exhaust treatment technologies are emerging for control of Diesel engine emissions, and in all sectors the level of sulfur in the fuel affects efficiency of the technology. Sulfur is a catalyst poison that reduces catalytic activity. Furthermore, in the context of catalytic control of Diesel emissions, high fuel sulfur also creates a secondary problem of particulate emission, due to catalytic oxidation of sulfur and reaction with water to form a sulfuric acid mist. This mist is collected as a portion of particulate emissions.

Compression ignition engine emissions differ from those of spark ignition engines due to the different method employed to initiate combustion. Compression ignition requires combustion of fuel droplets in a very lean air/fuel mixture. The combustion process leaves tiny particles of carbon behind and leads to significantly higher particulate emissions than are present in gasoline engines. Due to the lean operation the CO and gaseous hydrocarbon emissions are significantly lower than the gasoline engine. However, significant quantities of unburned hydrocarbon are adsorbed on the carbon particulate. These hydrocarbons are referred to as SOF (soluble organic fraction). Thus, the root cause of health concerns over diesel emissions can be traced to the inhalation of these very small carbon particles containing toxic hydrocarbons deep into the lungs.

While an increase in combustion temperature can reduce particulate, this leads to an increase in NOx emission by the well-known Zeldovitch mechanism. Thus, it becomes necessary to trade off particulate and NOx emissions to meet emissions legislation.

Available evidence strongly suggests that ultra-low sulfur fuel is a significant technology enabler for catalytic treatment of diesel exhaust to control emissions. Fuel sulfur levels of below 15 ppm, likely, are required to achieve particulate levels below 0.01 g/bhp-hr. Such levels would be very compatible with catalyst combinations for exhaust treatment now emerging, which have shown capability to achieve NOx emissions around 0.5 g/bhp-hr. Furthermore, NOx trap systems are extremely sensitive to fuel sulfur and available evidence suggests that they need would sulfur levels below 10 ppm to remain active.

In the face of ever-tightening sulfur specifications in transportation fuels, sulfur removal from petroleum feedstocks and products will become increasingly important in years to come. While legislation on sulfur in diesel fuel in Europe, Japan and the U.S. has recently lowered the specification to 0.05 percent by weight (max.), indications are that future specifications may go far below the current 0.05 percent by weight level.

Conventional hydrodesulfurization (HDS) catalysts can be used to remove a major portion of the sulfur from petroleum distillates for the blending of refinery transportation fuels, but they are not active for removing sulfur from compounds where the sulfur atom is sterically hindered as in multi-ring aromatic sulfur compounds. This is especially true where the sulfur heteroatom is doubly hindered (e.g., 4,6-dimethyldibenzothiophene). Using conventional hydrodesulfurization catalysts at high temperatures would cause yield loss, faster catalyst coking, and product quality deterioration (e.g., color). Using high pressure requires a large capital outlay.

In order to meet stricter specifications in the future, such hindered sulfur compounds will also have to be removed from distillate feedstocks and products. There is a pressing need for economical removal of sulfur from distillates and other hydrocarbon products.

The art is replete with processes said to remove sulfur from distillate feedstocks and products. One known method involves the oxidation of petroleum fractions containing at least a major amount of material boiling above a very high-boiling hydrocarbon materials (petroleum fractrions containing at least a major amount of material boiling above about 550° F.) followed by treating the effluent containing the oxidized compounds at elevated temperatures to form hydrogen sulfide (500° F. to 1350° F.) and/or hydroprocessing to reduce the sulfur content of the hydrocarbon material. See, for example, U.S. Pat. No. 3,847,798 in the name of Jin Sun Yoo and U.S. Pat. No. 5,288,390 in the name of Vincent A. Durante. Such methods have proven to be of only limited utility since only a rather low degree of desulfurization is achieved. In addition, substantial loss of valuable products may result due to cracking and/or coke formation during the practice of these methods. Therefore, it would be advantageous to develop a process which gives an increased degree of desulfuriztion while decreasing cracking or coke formation.

Several different oxygenation methods for improving fuels have been described in the past. For example, U.S. Pat. No. 2,521,698 describes a partial oxidation of hydrocarbon fuels as improving cetane number. This patent suggests that the fuel should have a relatively low aromatic ring content and a high paraffinic content. U.S. Pat. No. 2,912,313 states that an increase in cetane number is obtained by adding both a peroxide and a dihalo compound to middle distillate fuels. U.S. Pat. No. 2,472,152 describes a method for improving the cetane number of middle distillate fractions by the oxidation of saturated cyclic hydrocarbon or naphthenic hydrocarbons in such fractions to form naphthenic peroxides. This patent suggests that the oxidation may be accelerated in the presence of an oil-soluble metal salt as an initiator, but is preferably carried out in the presence of an inorganic base. However, the naphthenic peroxides formed are deleterious gum initiators. Consequently, gum inhibitors such as phenols, cresols and cresyic acids must be added to the oxidized material to reduce or prevent gum formation. These latter compounds are toxic and carcinogenic.

U.S. Pat. No. 4,494,961 in the name of Chaya Venkat and Dennnis E. Walsh relates to improving the cetane number of raw, untreated, highly aromatic, middle distillate fractions having a low hydrogen content by contacting the fraction at a temperature of from 50° C. to 350° C. and under mild oxidizing conditions in the presence of a catalyst which is either (i) an alkaline earth metal permanganate, (ii) an oxide of a metal of Groups IB, IIB, IIIB, IVB, VB, VIB, VIIB or VIIIB of the periodic table, or a mixture of (i) and (ii). European Patent Application 0 252 606 A2 also relates to improving cetane number of a middle distillate fuel fraction which may be hydro-refined by contacting the fraction with oxygen or oxidant, in the presence of catalytic metals such as tin, antimony, lead, bismuth and transition metals of Groups IB, IIB, VB, VIB, VIIB and VIIIB of the periodic table, preferably as an oil-soluble metal salt. The application states that the catalyst selectively oxidizes benzylic carbon atoms in the fuel to ketones.

Recently, U.S. Pat. No. 4,723,963 in the name of William F. Taylor suggests that cetane number is improved by including at least 3 weight percent oxygenated aromatic compounds in middle distillate hydrocarbon fuel boiling in the range of 160° C. to 400° C. This patent states that the oxygenated alkylaromatics and/or oxygenated hydroaromatics are preferably oxygenated at the benzylic carbon proton.

More recently, oxidative desulfurization of middle distillates by reaction with aqueous hydrogen peroxide catalyzed by phosphotungstic acid and tri-n-octylmethylammonium chloride as phase transfer reagent followed by silica adsorption of oxidized sulfur compounds has been described by Collins et al. (Journal of Molecular Catalysis (A): Chemical 117 (1997) 397-403). Collins et al. described the oxidative desulfurization of a winter grade diesel oil which had not undergone hydrotreating. While Collins et al. suggest that the sulfur species resistant to hydrodesulfurization should be susceptible to oxidative desulfurization, the concentrations of such resistant sulfur components in hydrodesulfurized diesel may already be relatively low compared with the diesel oils treated by Collins et al.

U.S. Pat. No. 5,814,109 in the name of Bruce R. Cook, Paul J. Berlowitz and Robert J. Wittenbrink relates to producing Diesel fuel additive, especially via a Fischer-Tropsch hydrocarbon synthesis process, preferably a non-shifting process. In producing the additive, an essentially sulfur free product of these Fischer-Tropsch processes is separated into a high-boiling fraction and a low-boiling fraction, e.g., a fraction boiling below 700° F. The high-boiling of the Fischer-Tropsch reaction product is hydroisomerizied at conditions said to be sufficient to convert the high-boiling fraction to a mixture of paraffins and isoparaffins boiling below 700° F. This mixture is blended with the low-boiling of the Fischer-Tropsch reaction product to recover the diesel additive said to be useful for improving the cetane number or lubricity, or both the cetane number and lubricity, of a mid-distillate, Diesel fuel.

U.S. Pat. No. 6,087,544 in the name of Robert J. Wittenbrink, Darryl P. Klein, Michele S Touvelle, Michel Daage and Paul J. Berlowitz relates to processing a distillate feedstream to produce distillate fuels having a level of sulfur below the distillate feedstream. Such fuels are produced by fractionating a distillate feedstream into a light fraction, which contains only from about 50 to 100 ppm of sulfur, and a heavy fraction. The light fraction is hydrotreated to remove substantially all of the sulfur therein. The desulfurized light fraction, is then blended with one half of the heavy fraction to product a low sulfur distillate fuel, for example 85 percent by weight of desulfurized light fraction and 15 percent by weight of untreated heavy fraction reduced the level of sulfur from 663 ppm to 310 ppm. However, to obtain this low sulfur level only about 85 percent of the distillate feedstream is recovered as a low sulfur distillate fuel product.

There is, therefore, a present need for compositions of fuels for transportation, particularly organic compositions which are liquid at ambient conditions, particularly compositions, which do not have the above disadvantages.

This invention is directed to overcoming the problems set forth above in order to provide components for refinery blending of transportation fuels friendly to the environment.

SUMMARY OF THE INVENTION

Economical compositions are provided for transportation fuels or blending components for transportation fuels, particularly organic compositions which are liquid at ambient conditions. More specifically, compositions comprising suitable organic distillates, as a predominant component, and limited, but essential, amounts of a component comprising oxygen-containing organic materials, which materials are typically derived from natural petroleum. Beneficially, the oxygen content of these transportation fuels is at least 0.02 percent by weight. Preferably the oxygen content these transportation fuels is in a range from about 0.2 percent to about 10 percent by weight.

One aspect of the invention is a composition for fuel or blending component of fuels which composition comprises: as a predominant component organic distillates, which predominant component exhibits a suitable initial boiling point and contains less than 15 ppm sulfur; and one or more oxygen-containing organic compounds in amounts such that the oxygen content of the fuel is in a range from about 0.2 percent to about 20 percent oxygen.

Beneficially, in composition according to invention the amounts of the oxygen-containing organic compounds are such that $$[10^\circ\ \text{C.}+(\text{IBP})_{composition}]>(\text{IBP})_{distillates},$$

where $(\text{IBP})_{composition}$ is the initial boiling point of the composition and $(\text{IBP})_{distillates}$ is the initial boiling point of the distillates.

In one class of compositions the predominant component is a mixture of organic compounds derived from natural petroleum. In another class of compositions the predominant component comprises alkanes containing from 5 to about 15 carbon atoms of which at least about 85 percent are normal alkanes. Advantageously composition according to the invention further comprising an effective amount of one or more fuel additives which enhance desired fuel properties.

This invention contemplates the use of fuel additives which are components known to enhance desired fuel properties. Typically, fuel additives are useful at low levels, i.e., less than 5 percent based upon the total weight of fuel, and often an effective amount is in a range upward from 0.01 percent and can even be as low as 0.05 percent for some cetane improvers. Useful fuel additives include cetane improvers, dehaziers/demulsifiers, anti-oxidants, metal deactivators, corrosion inhibitors, anti-foam agents, lubricity improvers, dispersents, detergents, and cold flow improvers such as pour depressants and cloud point depressants. A preferred class of cold flow improvers are selected from the group consisting of copolymers of ethylene and vinyl acetate, which enhances cold flow properties.

One aspect of the invention is a fuel for use in compression ignition internal combustion engines, comprising: as a predominant component organic distillates, and one or more oxygen-containing organic compounds in amounts such that the oxygen content of the fuel is in a range from about 0.2 percent to about 10 percent oxygen, and wherein the fuel exhibits a suitable flash point of at least 38° C. as measure by ASTM D93, and contains less than 15 ppm sulfur. Advantageously, the fuel exhibits a suitable flash point of at least 49° C. Advantageously, compositions of the invention further comprising an effective amount of one or more Diesel fuel additives selected from the group consisting of copolymers of ethylene and vinyl acetate, which enhances cold flow properties of Diesel fuel.

Another aspect of the invention is a fuel for use in spark ignition internal combustion engines, comprising: as a predominant component organic distillates, and one or more oxygen-containing organic compounds in amounts such that the oxygen content of the fuel is in a range from about 0.2 percent to about 10 percent oxygen, and wherein the fuel exhibits a suitable Reid vapor pressure of at least 6 psi and contains less than 15 ppm sulfur.

One aspect of the invention is a composition for fuel or blending component for fuels which are liquid at ambient conditions, which composition comprises: as a predominant component organic distillates which contain less than 15 ppm sulfur, and oxygen-containing organic compounds derived from natural petroleum in amounts such that the oxygen content of the fuel is in a range from about 0.2 percent to about 10 percent oxygen, with the proviso that at least 10 percent of the oxygen is contained in cyclic benzylic ketones. Beneficially, composition according to invention at least 5 percent of the oxygen content of the fuel is contained in cyclic benzylic diketones. Beneficially, compositions of the invention further comprising an effective amount of one or more fuel additives which enhance desired fuel properties.

A preferred composition for fuel or blending component for fuels, which are liquid at ambient conditions comprises: as a predominant component petroleum distillates which contain less than 15 ppm sulfur, and oxygen-containing organic compounds derived from natural petroleum in amounts such that the oxygen content of the fuel is in a range from about 0.2 percent to about 10 percent oxygen, with the proviso that at least 10 percent of the oxygen is contained in aryl oxygenates represented by

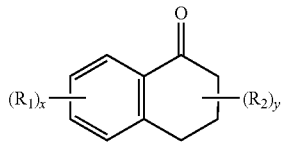

where $R_1$ are independently selected from the group consisting of hydrogen and hydrocarbon radicals containing from 1 to about 10 carbon atoms, x is an integer from 1 to 4; $R_2$ are independently selected from the group consisting of hydrogen, hydroxyl, carbonyl oxygen and organic moieties containing from 1 to about 10 carbon atoms, and y is an integer from 1 to 3.

A preferred class of compositions comprises aryl oxygenates of the types represented by the following:

TYPE I

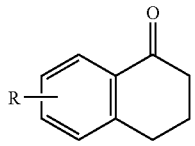

-continued

TYPE II

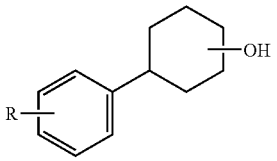

TYPE III

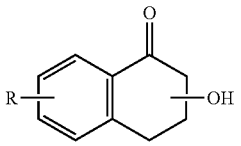

TYPE IV

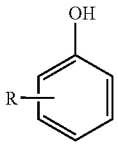

TYPE V

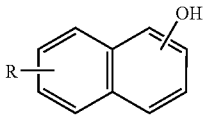

TYPE VI

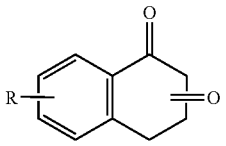

TYPE VII

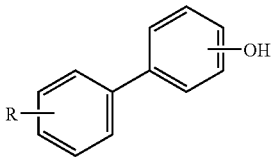

TYPE VIII

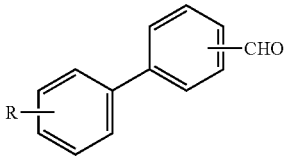

where R are independently selected from the group consisting of hydrogen and hydrocarbon radicals containing from 1 to about 10 carbon atoms.

In a preferred composition at least 10 percent of the oxygen is contained in aryl oxygenates represented by

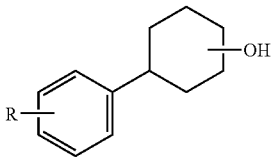

and

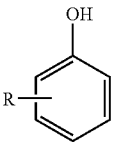

Where R is hydrogen or a hydrocarbon radical containing from 1 to about 10 carbon atoms.

One aspect of this invention provides a composition formed by an integrate process which comprises: partitioning by distillation an organic feedstock comprising a mixture of organic compounds derived from natural petroleum, the mixture having a gravity ranging from about 10° API to about 75° API to provide at least one low-boiling organic part consisting of a sulfur-lean, mono-aromatic-rich fraction, and a high-boiling organic part consisting of a sulfur-rich, mono-aromatic-lean fraction; contacting a gaseous source of dioxygen with at least a portion of the low-boiling organic part in a liquid reaction medium containing a soluble catalyst system comprising a source of at least one catalyst metal selected from the group consisting of manganese, cobalt, nickel, chromium, vanadium, molybdenum, tungsten, tin, cerium, or mixture thereof, while maintaining the liquid reaction medium substantially free of halogen and/or halogen-containing compounds, to form a mixture of immiscible phases comprising hydrocarbons, oxygenated organic compounds, water of reaction, and acidic co-products; separating from the mixture of immiscible phases at least a first organic liquid of low density comprising hydrocarbons, oxygenated organic compounds and acidic co-products and second liquid of high density which contains at least portions of the catalyst metal, water of reaction and acidic co-products; and contacting all or a portion of the separated organic liquid with a neutralizing agent and recovering a low-boiling oxygenated product having a low content of acidic co-products. The integrated process includes contacting the high-boiling organic part with an immiscible phase comprising at least one organic peracid or precursors of organic peracid in a liquid oxidation reaction mixture maintained substantially free of catalytic active metals and/or active metal-containing compounds and under conditions suitable for oxidation of one or more of the sulfur-containing and/or nitrogen-containing organic compounds; separating at least a portion of the immiscible peracid-containing phase from the oxidized phase of the reaction mixture; and contacting the oxidized phase of the reaction mixture with a solid sorbent, an ion exchange resin, and/or a suitable immiscible liquid containing a solvent or a soluble basic chemical compound, to obtain a high-boiling product containing less sulfur and/or less nitrogen than the high-boiling fraction.

The catalyst system for selective oxygenation of organic compounds according to the invention comprises a source of catalyst metal selected from the group consisting of manganese, cobalt, nickel, chromium, vanadium, molybdenum, tungsten, tin, cerium, or mixture thereof, in the form of a salt of an organic acid having up to about 8 carbon atoms.

Preferably, the catalyst system for selective oxygenation of organic compounds according to the invention comprises a source of catalyst metal selected from the group consisting of compounds represented by formula $$M[RCOCH{=}C(O{-})R']_n$$

where n is 2 or 3. The M is one or more member of the group consisting of manganese, cobalt, nickel, chromium, vanadium, molybdenum, tungsten, tin and cerium, and more preferably the group consisting of manganese, cobalt, or cerium. The R and R' are the same or different members of the group consisting of a hydrogen atom and methyl, alkyl, aryl, alkenyl and alkynyl groups having up to about 20 carbon atoms, and more preferably up to about 10 carbon atoms.

Advantageously, the catalyst system for selective oxygenation of organic compounds according to the invention comprises a source of catalyst metal selected from the group consisting of compounds represented by formula $$Mn[RCOCH{=}C(O{-})R']_2,$$

$$Co[RCOCH{=}C(O{-})R']_2 \text{ and/or}$$

$$Ce[RCOCH{=}C(O{-})R']_3$$

where R and R' are the same or different members of the group consisting of a hydrogen atom and methyl, alkyl, aryl, alkenyl and alkynyl groups having up to about 20 carbon atoms, and more preferably up to about 8 carbon atoms. Most preferred, are a source of catalyst metal selected from the group consisting of compounds represented by formula $$Mn[CH_3COCH{=}C(O{-})CH_3]_2$$

$$Co[CH_3COCH{=}C(O{-})CH_3]_2$$

$$Ce[CH_3COCH{=}C(O{-})CH_3]_3$$

Beneficially, at least a portion of the separated organic liquid is contacted with an aqueous solution of a chemical base, and the recovered oxygenated product exhibits a total acid number of less than about 20 mg KOH/g. The recovered oxygenated product advantageously exhibits a total acid number of less than about 10 mg KOH/g. More preferred are oxygenated products which exhibit a total acid number of less than about 5, and most preferred less than about 1. Preferably, the chemical base is a compound selected from the group consisting of sodium, potassium, barium, calcium and magnesium in the form of hydroxide, carbonate or bicarbonate.

In one preferred aspect of the invention, all or at least a potion of the organic feedstock is a product of a process for hydrogenation of a petroleum distillate consisting essentially of material boiling between about 50° C. and about 425° C. which hydrogenation process includes reacting the petroleum distillate with a source of hydrogen at hydrogenation conditions in the presence of a hydrogenation catalyst to assist by hydrogenation removal of sulfur and/or nitrogen from the hydrotreated petroleum distillate.

Generally for use in this invention, the immiscible phase is formed by admixing a source of hydrogen peroxide and/or alkylhydroperoxide, an aliphatic monocarboxylic acid of 2 to about 6 carbon atoms, and water. Advantageously, the immiscible phase is formed by admixing hydrogen peroxide, acetic acid, and water. Advantageously, at least a portion of the separated peracid-containing phase is recycled to the reaction mixture.

Preferably, the conditions of oxidation include temperatures in a range upward from about 25° C. to about 250° C. and sufficient pressure to maintain the reaction mixture substantially in a liquid phase.

Sulfur-containing organic compounds in the oxidation feedstock include compounds in which a sulfur atom is sterically hindered, as for example in multi-ring aromatic sulfur compounds. Typically, the sulfur-containing organic compounds include at least sulfides, heteroaromatic sulfides, and/or compounds selected from the group consisting of substituted benzothiophenes and dibenzothiophenes.

Beneficially, the instant oxidation process is very selective in that selected organic peracids in a liquid phase reaction mixture maintained substantially free of catalytic active metals and/or active metal-containing compounds, preferentially oxidize compounds in which a sulfur atom is sterically hindered rather than aromatic hydrocarbons.

Preferably, for making composition of the present invention, suitable distillate fractions are hydrodesulfureized before being selectively oxidized, and more preferably using a facility capable of providing effluents of at least one low-boiling fraction and one high-boiling fraction.

For a more complete understanding of the present invention, reference should now be made to the embodiments illustrated in greater detail and described below by way of examples of the invention.

GENERAL DESCRIPTION

Advantageously, catalyst systems of the invention comprising a source of catalyst metal selected from the group consisting of manganese, cobalt, nickel, chromium, vanadium, molybdenum, tungsten, tin cerium, or mixture thereof in elemental, combined, or ionic form. The catalyst metal is preferably selected from the group consisting of manganese and cobalt or mixture thereof, and the metal may be employed Preferably the source of catalyst metal is a compound having formula $M[CH_3COCH{=}C(O{-})CH_3]_x$ where M is the catalyst metal, and x is 2 or 3. When the reaction medium is a mixture of hydrocarbons, having a gravity ranging from about 10° API to about 100° API, the preferred sources of catalyst metals are $Co[CH_3COCH{=}C(O{-})CH_3]_2$, $Mn[CH_3COCH{=}C(O{-})CH_3]_2$ and $Ce[CH_3COCH{=}C(O{-})CH_3]_2$ or a combination thereof. When the reaction medium is the low-boiling fraction having the minor amount of sulfur-containing organic compounds, the more preferred source of catalyst metal is $Co[CH_3COCH{=}C(O{-})CH_3]_2$.

Suitable feedstocks generally comprise most refinery streams consisting substantially of hydrocarbon compounds which are liquid at ambient conditions. Suitable oxidation feedstock generally has an API gravity ranging from about 10° API to about 100° API, preferably from about 10° API to about 80° API, and more preferably from about 15° API to about 75° API for best results. These streams include, but are not limited to, fluid catalytic process naphtha, fluid or delayed process naphtha, light virgin naphtha, hydrocracker naphtha, hydrotreating process naphthas, alkylate, isomerate, catalytic reformate, and aromatic derivatives of these streams such benzene, toluene, xylene, and combinations thereof. Catalytic reformate and catalytic cracking process naphthas can often be split into narrower boiling range streams such as light and heavy catalytic naphthas and light and heavy catalytic reformate, which can be specifically customized for use as a feedstock in accordance with the present invention. The preferred streams are light virgin naphtha, catalytic cracking naphthas including light and heavy catalytic cracking unit naphtha, catalytic reformate including light and heavy catalytic reformate and derivatives of such refinery hydrocarbon streams.

Suitable oxidation feedstocks generally include refinery distillate steams boiling at a temperature range from about 50° C. to about 425° C., preferably 150° C. to about 400° C., and more preferably between about 175° C. and about 375° C. at atmospheric pressure for best results. These streams include, but are not limited to, virgin light middle distillate, virgin heavy middle distillate, fluid catalytic cracking process light catalytic cycle oil, coker still distillate, hydrocracker distillate, and the collective and individually hydrotreated embodiments of these streams. The preferred streams are the collective and individually hydrotreated embodiments of fluid catalytic cracking process light catalytic cycle oil, coker still distillate, and hydrocracker distillate.

It is also anticipated that one or more of the above distillate steams can be combined for use as oxidation feedstock. In many cases performance of the refinery transportation fuel or blending components for refinery transportation fuel obtained from the various alternative feedstocks may be comparable. In these cases, logistics such as the volume availability of a stream, location of the nearest connection and short term economics may be determinative as to what stream is utilized.

Typically, sulfur compounds in petroleum fractions are relatively non-polar, heteroaromatic sulfides such as substituted benzothiophenes and dibenzothiophenes. At first blush it might appear that heteroaromatic sulfur compounds could be selectively extracted based on some characteristic attributed only these heteroaromatics. Even though the sulfur atom in these compounds has two, non-bonding pairs of electrons which would classify them as a Lewis base, this characteristic is still not sufficient for them to be extracted by a Lewis acid. In other words, selectively extraction of heteroaromatic sulfur compounds to achieve lower levels of sulfur requires greater difference in polarity between the sulfides and the hydrocarbons.

By means of liquid phase oxidation according to this invention it is possible to selectively convert these sulfides into, more polar, Lewis basic, oxygenated sulfur compounds such as sulfoxides and sulfones. Compounds such as dimethylsulfide are very non-polar molecules. Accordingly, by selectively oxidizing heteroaromatic sulfides such as benzo- and dibenzothiophene found in a refinery streams, processes of the invention are able to selectively bring about a higher polarity characteristic to these heteroaromatic compounds. Where the polarity of these unwanted sulfur compounds is increased by means of liquid phase oxidation according to this invention, they can be selectively extracted by a polar solvent and/or a Lewis acid sorbent while the bulk of the hydrocarbon stream is unaffected.

Other compounds which also have non-bonding pairs of electrons include amines. Heteroaromatic amines are also found in the same stream that the above sulfides are found. Amines are more basic than sulfides. The lone pair of electrons functions as a Bronstad-Lowry base (proton acceptor) as well as a Lewis base (electron-donor). This pair of electrons on the atom makes it vulnerable to oxidation in manners similar to sulfides.

As disclosed herein oxidation feedstock is contacted with an immiscible phase comprising at least one organic peracid which contains the —OOH substructure or precursors of organic peracid, and the liquid reaction mixture is maintained substantially free of catalytic active metals and/or active metal-containing compounds and under conditions suitable for oxidation of one or more of the sulfur-containing and/or nitrogen-containing organic compounds. Organic peracids for use in this invention are preferably made from a combination of hydrogen peroxide and a carboxylic acid.

With respect to the organic peracids the carbonyl carbon is attached to hydrogen or a hydrocarbon radical. In general such hydrocarbon radical contains from 1 to about 12 carbon atoms, preferably from about 1 to about 8 carbon atoms. More preferably, the organic peracid is selected from the group consisting of performic acid, peracetic acid, trichloroacetic acid, perbenzoic acid and perphpthalic acid or precursors thereof. For best results processes of the present invention employ peracetic acid or precursors of peracetic acid.

Broadly, the appropriate amount of organic peracid used herein is the stoichiometric amount necessary for oxidation of one or more of the sulfur-containing and/or nitrogen-containing organic compounds in the oxidation feedstock and is readily determined by direct experimentation with a selected feedstock. With a higher concentration of organic peracid, the selectivity generally tends to favor the more highly oxidized sulfone which beneficially is even more polar than the sulfoxide.

Applicants believe the oxidation reaction involves rapid reaction of organic peracid with the divalent sulfur atom by a concerted, non-radical mechanism whereby an oxygen atom is actually donated to the sulfur atom. As stated previously, in the presence of more peracid, the sulfoxide is further converted to the sulfone, presumably by the same mechanism. Similarly, it is expected that the nitrogen atom of an amino is oxidized in the same manner by hydroperoxy compounds.

The statement that oxidation according to the invention in the liquid reaction mixture comprises a step whereby an oxygen atom is donated to the divalent sulfur atom is not to be taken to imply that processes according to the invention actually proceeds via such a reaction mechanism.

By contacting oxidation feedstock with a peracid-containing immiscible phase in a liquid reaction mixture maintained substantially free of catalytic active metals and/or active metal-containing compounds, the tightly substituted sulfides are oxidized into their corresponding sulfoxides and sulfones with negligible if any co-oxidation of mononuclear aromatics. These oxidation products due to their high polarity, can be readily removed by separation techniques such as adsorption and extraction. The high selectivity of the oxidants, coupled with the small amount of tightly substituted sulfides in hydrotreated streams, makes the instant invention a particularly effective deep desulfurization means with minimum yield loss. The yield loss corresponds to the amount of tightly substituted sulfides oxidized. Since the amount of tightly substituted sulfides present in a hydrotreated crude is rather small, the yield loss is correspondingly small.

Broadly, the liquid phase oxidation reactions are rather mild and can even be carried out at temperatures as low as room temperature. More particularly, the liquid phase oxidation will be conducted under any conditions capable of converting the tightly substituted sulfides into their corresponding sulfoxides and sulfones at reasonable rates.

In accordance with this invention conditions of the liquid mixture suitable for oxidation during the contacting the oxidation feedstock with the organic peracid-containing immiscible phase include any pressure at which the desired oxidation reactions proceed. Typically, temperatures upward from about 10° C. are suitable. Preferred temperatures are between about 25° C. and about 250° C., with temperatures between about 50° and about 150° C. being more preferred. Most preferred temperatures are between about 115° C. and about 125° C.

Integrated processes of the invention can include one or more selective separation steps using solid sorbents capable of removing sulfoxides and sulfones. Non-limiting examples of such sorbents, commonly known to the skilled artisan, include activated carbons, activated bauxite, activated clay, activated coke, alumina, and silica gel. The oxidized sulfur containing hydrocarbon material is contacted with solid sorbent for a time sufficient to reduce the sulfur content of the hydrocarbon phase.

Integrated processes of the invention can include one or more selective separation steps using an immiscible solvent having a dielectric constant suitable to selectively extract oxidized sulfur-containing and/or nitrogen-containing organic compounds. Preferably the present invention uses an solvent which exhibits a dielectric constant in a range from about 24 to about 80. For best results processes of the present invention employ solvent comprises a compound is selected from the group consisting of water, methanol, ethanol, and mixtures thereof.

Integrated processes of the invention can include one or more selective separation steps using an immiscible liquid containing a soluble basic chemical compound. The oxidized sulfur containing hydrocarbon material is contacted with the solution of chemical base for a time sufficient to reduce the sulfur content of the hydrocarbon phase.

Generally, the suitable basic compounds include ammonia or any hydroxide, carbonate or bicarbonate of an element selected from Group I, II, and/or III of the periodic table, although calcined dolomitic materials and alkalized aluminas can be used. In addition mixtures of different bases can be utilized. Preferably the basic compound is a hydroxide, carbonate or bicarbonate of an element selected from Group I and/or II element. More preferably, the basic compound is selected from the group consisting of sodium, potassium, barium, calcium and magnesium hydroxide, carbonate or bicarbonate. For best results processes of the present invention employ an aqueous solvent containing an alkali metal hydroxide, preferably selected from the group consisting of sodium, potassium, barium, calcium and magnesium hydroxide. In general, an aqueous solution of the base hydroxide at a concentration on a mole basis of from about 1 mole of base to 1 mole of sulfur up to about 4 moles, of base per mole of sulfur is suitable.

In carrying out a sulfur separation step according to this invention, pressures of near atmospheric and higher may be suitable. For example, pressures up to 100 atmosphere can be used.

Processes of the present invention advantageously include catalytic hydrodesulfurization of the oxidation feedstock to form hydrogen sulfide which may be separated as a gas from the liquid feedstock, collected on a solid sorbent, and/or by washing with aqueous liquid. Where the oxidation feedstock is a product of a process for hydrogenation of a petroleum distillate to facilitate removal of sulfur and/or nitrogen from the hydrotreated petroleum distillate, the amount of peracid necessary for the instant invention is the stoichiometric amount necessary to oxidize the tightly substituted sulfides contained in the hydrotreated stream being treated in accordance herewith. Preferably an amount which will oxidize all of the tightly substituted sulfides will be used.

Useful distillate fractions for hydrogenation in the present invention consists essentially of any one, several, or all refinery streams boiling in a range from about 50° C. to about 425° C., preferably 150° C. to about 400° C., and more preferably between about 175° C. and about 375° C. at atmospheric pressure. For the purpose of the present invention, the term "consisting essentially of" is defined as at least 95 percent of the feedstock by volume. The lighter hydrocarbon components in the distillate product are generally more profitably recovered to gasoline and the presence of these lower boiling materials in distillate fuels is often constrained by distillate fuel flash point specifications. Heavier hydrocarbon components boiling above 400° C. are generally more profitably processed as FCC Feed and converted to gasoline. The presence of heavy hydrocarbon components in distillate fuels is further constrained by distillate fuel end point specifications.

The distillate fractions for hydrogenation in the present invention can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80 percent by weight (FIA). The majority of coker distillate and cycle oil aromatics are present as mono-aromatics and di-aromatics with a smaller portion present as tri-aromatics. Virgin stocks such as high and low sulfur virgin distillates are lower in aromatics content ranging as high as 20 percent by weight aromatics. Generally, the aromatics content of a combined hydrogenation facility feedstock will range from about 5 percent by weight to about 80 percent by weight, more typically from about 10 percent by weight to about 70 percent by weight, and most typically from about 20 percent by weight to about 60 percent by weight. In a distillate hydrogenation facility with limited operating capacity, it is generally profitable to process feedstocks in order of highest aromaticity, since catalytic processes often proceed to equilibrium product aromatics concentrations at sufficient space velocity. In this manner, maximum distillate pool dearomatization is generally achieved.

Sulfur concentration in distillate fractions for hydrogenation in the present invention is generally a function of the high and low sulfur crude mix, the hydrogenation capacity of a refinery per barrel of crude capacity, and the alternative dispositions of distillate hydrogenation feedstock components. The higher sulfur distillate feedstock components are generally virgin distillates derived from high sulfur crude, coker distillates, and catalytic cycle oils from fluid catalytic cracking units processing relatively higher sulfur feedstocks. These distillate feedstock components can range as high as 2 percent by weight elemental sulfur but generally range from about 0.1 percent by weight to about 0.9 percent by weight elemental sulfur. Where a hydrogenation facility is a two-stage process having a first-stage denitrogenation and desulfurization zone and a second-stage dearomatization zone, the dearomatization zone feedstock sulfur content can range from about 100 ppm to about 0.9 percent by weight or as low as from about 10 ppm to about 0.9 percent by weight elemental sulfur.

Nitrogen content of distillate fractions for hydrogenation in the present invention is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstock components can have total nitrogen concentrations ranging as high as 2000 ppm, but generally range from about 5 ppm to about 900 ppm.

The catalytic hydrogenation process may be carried out under relatively mild conditions in a fixed, moving fluidized or ebullient bed of catalyst. Preferably a fixed bed of catalyst is used under conditions such that relatively long periods elapse before regeneration becomes necessary, for example a an average reaction zone temperature of from about 200° C. to about 450° C., preferably from about 250° C. to about 400° C., and most preferably from about 275° C. to about 350° C. for best results, and at a pressure within the range of from about 6 to about 160 atmospheres.

A particularly preferred pressure range within which the hydrogenation provides extremely good sulfur removal while minimizing the amount of pressure and hydrogen required for the hydrodesulfurization step are pressures within the range of 20 to 60 atmospheres, more preferably from about 25 to 40 atmospheres.

According the present invention, suitable distillate fractions are preferably hydrodesulfureized before being selectively oxidized, and more preferably using a facility capable of providing effluents of at least one low-boiling fraction and one high-boiling fraction.

Where the particular hydrogenation facility is a two-stage process, the first stage is often designed to desulfurize and denitrogenate, and the second stage is designed to dearomatize. In these operations, the feedstocks entering the dearomatization stage are substantially lower in nitrogen and sulfur content and can be lower in aromatics content than the feedstocks entering the hydrogenation facility.

Generally, the hydrogenation process useful in the present invention begins with a distillate fraction preheating step. The distillate fraction is preheated in feed/effluent heat exchangers prior to entering a furnace for final preheating to a targeted reaction zone inlet temperature. The distillate fraction can be contacted with a hydrogen stream prior to, during, and/or after preheating. The hydrogen-containing stream can also be added in the hydrogenation reaction zone of a single-stage hydrogenation process or in either the first or second stage of a two-stage hydrogenation process.

The hydrogen stream can be pure hydrogen or can be in admixture with diluents such as hydrocarbon, carbon monoxide, carbon dioxide, nitrogen, water, sulfur compounds, and the like. The hydrogen stream purify should be at least about 50 percent by volume hydrogen, preferably at least about 65 percent by volume hydrogen, and more preferably at least about 75 percent by volume hydrogen for best results. Hydrogen can be supplied from a hydrogen plant, a catalytic reforming facility or other hydrogen producing process.

The reaction zone can consist of one or more fixed bed reactors containing the same or different catalysts. Two-stage processes can be designed with at least one fixed bed reactor for desulfurization and denitrogenation, and at least one fixed bed reactor for dearomatization. A fixed bed reactor can also comprise a plurality of catalyst beds. The plurality of catalyst beds in a single fixed bed reactor can also comprise the same or different catalysts. Where the catalysts are different in a multi-bed fixed bed reactor, the initial bed is generally for desulfurization and denitrogenation, and subsequent beds are for dearomatization.

Since the hydrogenation reaction is generally exothermic, interstage cooling, consisting of heat transfer devices between fixed bed reactors or between catalyst beds in the same reactor shell, can be employed. At least a portion of the heat generated from the hydrogenation process can often be profitably recovered for use in the hydrogenation process. Where this heat recovery option is not available, cooling may be performed through cooling utilities such as cooling water or air, or through use of a hydrogen quench stream injected directly into the reactors. Two-stage processes can provide reduced temperature exotherm per reactor shell and provide better hydrogenation reactor temperature control.

The reaction zone effluent is generally cooled and the effluent stream is directed to a separator device to remove the hydrogen. Some of the recovered hydrogen can be recycled back to the process while some of the hydrogen can be purged to external systems such as plant or refinery fuel. The hydrogen purge rate is often controlled to maintain a minimum hydrogen purity and remove hydrogen sulfide. Recycled hydrogen is generally compressed, supplemented with "make-up" hydrogen, and injected into the process for further hydrogenation.

Liquid effluent of the separator device can be processed in a stripper device where light hydrocarbons can be removed and directed to more appropriate hydrocarbon pools. Preferably the separator and/or stripper device includes means capable of providing effluents of at least one low-boiling liquid fraction and one high-boiling liquid fraction. Liquid effluent and/or one or more liquid fraction thereof is subsequently treated to incorporate oxygen into the liquid organic compounds therein and/or assist by oxidation removal of sulfur or nitrogen from the liquid products. Liquid products are then generally conveyed to blending facilities for production of finished distillate products.

Operating conditions to be used in the hydrogenation process include an average reaction zone temperature of from about 200° C. to about 450° C., preferably from about 250° C. to about 400° C., and most preferably from about 275° C. to about 350° C. for best results. Reaction temperatures below these ranges can result in less effective hydrogenation. Excessively high temperatures can cause the process to reach a thermodynamic aromatic reduction limit, hydrocracking, catalyst deactivation, and increase energy costs.

The hydrogenation process typically operates at reaction zone pressures ranging from about 400 psig to about 2000 psig, more preferably from about 500 psig to about 1500 psig, and most preferably from about 600 psig to about 1200 psig for best results. Hydrogen circulation rates generally range from about 500 SCF/Bbl to about 20,000 SCF/Bbl, preferably from about 2,000 SCF/Bbl to about 15,000 SCF/Bbl, and most preferably from about 3,000 to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

Useful catalyst for the hydrodesulfurization comprise a component capable to enhance the incorporation of hydrogen into a mixture of organic compounds to thereby form at least hydrogen sulfide, and a catalyst support component. The catalyst support component typically comprises mordenite and a refractory inorganic oxide such as silica, alumina, or silica-alumina. The mordenite component is present in the support in an amount ranging from about 10 percent by weight to about 90 percent by weight, preferably from about 40 percent by weight to about 85 percent by weight, and most preferably from about 50 percent by weight to about 80 percent by weight for best results. The refractory inorganic oxide, suitable for use in the present invention, has a pore diameter ranging from about 50 to about 200 Angstroms and more preferably from about 80 to about 150 Angstroms for best results. Mordenite, as synthesized, is characterized by its silicon to aluminum ratio of about 5:1 and its crystal structure.

Further reduction of such heteroaromatic sulfides from a distillate petroleum fraction by hydrotreating would require that the stream be subjected to very severe catalytic hydrogenation order to convert these compounds into hydrocarbons and hydrogen sulfide ($H_2S$), Typically, the larger any hydrocarbon moiety is, the more difficult it is to hydrogenate the sulfide. Therefore, the residual organo-sulfur compounds remaining after a hydrotreatment are the most tightly substituted sulfides.

Subsequent to desulfurization by catalytic hydrogenation, as disclosed herein further selective removal of sulfur or nitrogen from the desulfurized mixture of organic compounds can be accomplished by incorporation of oxygen into sulfur or nitrogen containing organic compounds thereby assisting in selective removal of sulfur or nitrogen from oxidation feedstocks.

GENERAL

Oxygenation of a hydrocarbon product was determined by the difference between the high precision carbon and hydrogen analysis of the feed and product.

$$\text{Oxygenation, percent,}=(\text{percent C}+\text{percent H})_{\textit{analysis of feed}}-(\text{percent C}+\text{percent H})_{\textit{analysis of oxygenated product}}$$

EXAMPLE 1

In this example a refinery distillate containing sulfur at a level of about 500 ppm was hydrotreated under conditions suitable to produce hydrodesulfurized distillate containing sulfur at a level of about 130 ppm, which was identified as hydrotreated distillate 150. Hydrotreated distillate 150 was cut by distillation into four fractions which were collected at temperatures according to the following schedule.

| Fraction | Temperatures, ° C. |
|---|---|
| 1 | Below 260 |
| 2 | 260 to 288 |
| 3 | 288 to 316 |
| 4 | Above 316 |

Analysis of hydrotreated distillate 150 over this range of distillation cut points is shown in Table I. In accordance with this invention a fraction collected below a temperature in the range from about 260° C. to about 300° C. splits hydrotreated distillate 150 into a sulfur-lean, monoaromatic-rich fraction and a sulfur-rich, monoaromatic-lean fraction.

EXAMPLE 2

In this example a refinery distillate containing sulfur at a level of about 500 ppm was hydrotreated under conditions suitable to produce a hydrodesulfurized distillate containing sulfur at a level of about 15 ppm, which was identified as hydrotreated distillate 15.

Analysis of hydrotreated distillate 15 over the range of distillation cut points is shown in Table II. In accordance with this invention a fraction collected below a temperature in the range from about 260° C. to about 300° C. splits hydrotreated distillate 15 into a sulfur-lean, monoaromatic-rich fraction and a sulfur-rich, monoaromatic-lean fraction.

TABLE I

ANALYSIS OF DISTILLATION FRACTIONS OF HYDROTREATED DISTILLATE 150

| | Fraction Number | | | | |
|---|---|---|---|---|---|
| Item | 1 | 2 | 3 | 4 | Total |
| Weight, % | 45 | 21 | 19 | 16 | 100 |
| Sulfur, ppm | 11.7 | 25 | 174 | 580 | 133 |
| Mono-Ar, % | 40.7 | 26.3 | 15.6 | 14.0 | 28.8 |
| Di-Ar, % | 0.4 | 5.0 | 5.4 | 5.6 | 3.1 |
| Tri-Ar, % | 0 | 0 | 0 | 0.8 | 0.1 |

Mono-Ar is mono-aromatics.
Di-Ar is di-aromatics.
Tri-Ar is tri-aromatics.

TABLE II

ANALYSIS OF DISTILLATION FRACTIONS OF HYDROTREATED DISTILLATE 15

| | Fraction Number | | | | |
|---|---|---|---|---|---|
| Item | 1 | 2 | 3 | 4 | Total |
| Weight, % | 53 | 16 | 20 | 11 | 100 |
| Sulfur, ppm | 1 | 2 | 13 | 80 | 12.3 |
| Mono-Ar, % | 35.8 | 20.9 | 14.8 | 12.0 | 5.6 |
| Di-Ar, % | 1.3 | 8.0 | 7.4 | 5.6 | 4.0 |
| Tri-Ar, % | 0 | 0 | 0 | 1.4 | 0.2 |

Mono-Ar is mono-aromatics.
Di-Ar is di-aromatics.
Tri-Ar is tri-aromatics.

EXAMPLE 3

This example describes a catalytic oxygenation according to the invention of a hydrotreated refinery distillate identified as S-25. A stirred reactor, having a nominal volume of 5 gallons and built of titanium, was charged with 18 lbs of S-25 and 18.81 grams of cobalt(II) acetylacetonate hydrate (Aldrich catalog no. 34,461-5, which contained 22.92 percent by weight cobalt). This provided a cobalt(II) acetylacetonate hydrate concentration of 0.23 percent by weight in the hydrotreated distillate, or 527 ppm cobalt in the distillate.

The reactor was then sealed, purged with nitrogen gas and pressurized to 100 psig. The agitation speed was 700 rpm. Heat was applied to the walls of the reactor via exterior electric heaters in order to preheat the reactor contents to 128° C.

Oxygenation of the reactor contents was initiated by introducing an oxygen-containing gas stream (about 8 percent molecular oxygen and 92 percent by molecular nitrogen volume) at an initial flow rate of 50 scfh into the bottom of the reactor underneath the bottom impeller of the agitator. This caused the liquid level within the reactor to rise as the gas became dispersed throughout the liquid. The gas leaving the top of the liquid level was mostly disengaged from the liquid within the upper portion of the reactor and flowed downstream through a water-cooled overhead condenser, through a gas-liquid separator (knock-out tank) and through a pressure-regulating control valve. A portion of this vent gas stream passed through several on-line analyzers which continuously monitored the concentrations of oxygen, carbon monoxide and carbon dioxide in the vent gas during the course of the batch oxygenation. Any liquid which was entrained with the gas stream leaving the oxygenation reactor was collected in the gas-liquid separator and continuously pumped back into the top of oxidation reactor via a gear pump.

Gas pressure in the oxygenation reactor was automatically controlled via a feedback control loop which adjusted a pressure-regulating control valve to achieve the desired reactor pressure. Temperature in the reactor was controlled via a controlled flow of distilled water through a cooling coil located in the lower portion of the oxygenation reactor. Flow of distilled water was controlled by manually adjusting a micro-metering valve upstream of the cooling coil. The cooling coil was operated at atmospheric pressure so that the distilled water entering the cooling coil flashed to steam, thereby removing heat from the reaction mixture via the vaporization of water. The oxygen concentration in the vent gas stream was controlled by adjusting the flow rate of oxygen-containing gas entering the oxygenation reactor. The flow rate of oxygen-containing gas was measured via a mass flow meter and controlled via a flow control valve.

After the initiation of oxygenation, the flow of oxygen-containing gas was slowly increased as the reaction temperature began to increase and the rate of oxygen consumption increased. After 10 minutes, the reaction temperature reached about 141° C. and the gas feed rate was 200 scfh with no oxygen detected in the vent gas. After 20 minutes, the reaction temperature reached about 142° C. with a gas feed rate of 375 scfh and 0.87 percent by volume oxygen in the vent gas. After 26 minutes, the reaction temperature was about 141° C. with a gas feed rate of 423 scfh and 1.36 percent by volume oxygen in the vent gas.

After 36 minutes, the batch reaction was ended by stopping the flow of oxygen-containing gas and purging the reactor with flowing nitrogen. As the reaction temperature decreased, the flow of distilled water to the cooling coil was stopped. The reactor was then depressurized and the contents of the reactor was emptied into a 5 gallon container. The product consisted of two layers of liquid with the bulk layer occupying approximately 95 percent of the total liquid volume.

Portions of the untreated bulk layer, identified as GS-25, were withdrawn for cetane rating and other Analysis. Analysis of GS-25 determined an oxygenation level of 2.75 percent, a sulfur level of 10 ppm, a nitrogen level of 7 ppm, and a total acid number of 10.7 mg KOH/g. The cetane rating of GS-25 was determined to be 59.9, however the cetane rating engine ran roughly. The cetane rating of the un-oxygenated distillate S-25 was 49.9.

EXAMPLE 4

This example describes post-oxygenation treatment of GS-25 using aqueous sodium bicarbonate solution which added cetane value. A portion GS-25 of Example 3 was treated with aqueous sodium bicarbonate solution, water washed, dried over anhydrous 3A molecular sieve, and filtered. Filtered material was submitted for cetane rating and other Analysis. Analysis of the treated portion of bulk layer determined an oxygenation level of 1.67 percent, a sulfur level of 7 ppm, a nitrogen level of 9 ppm, and a total acid number of 2.1 mg KOH/g. The cetane rating of this post-treated bulk layer was determined to be 62.9, but the cetane rating engine ran very smoothly in this case.

EXAMPLE 5

Hydrotreated refinery distillate S-25 was partitioned by distillation to provide feedstock for catalytic oxygenation using soluble organic compounds containing a cobalt(II) salt. The fraction collected below temperatures of about 288° C. was a sulfur-lean, mono-aromatic-rich fraction identified as S-25-B288, and the fraction collected above temperatures of about 288° C. was a sulfur-rich, mono-aromatic-leas fraction identified as S-25-A288. Analysis of S-25-B288 determined a sulfur content of 10 ppm, a nitrogen content of 5 ppm, and 87.01 percent carbon, 12.98 percent hydrogen with aromatic carbon of 16.5 percent.

A 300 mL Parr pressure reactor bottom was charged with S-25-B288 and cobalt(II) bis-acetylacetonate hydrate to provide a cobalt concentration of 750 ppm. The reactor was sealed, flushed and filled with nitrogen at 100 psig. Contents of the reactor was heated with agitation to a set point temperature of about 135° C. After short period at temperature, the nitrogen flow was replaced by a gaseous mixture of 8 percent molecular oxygen in nitrogen at a rate of 7 scfh.

At the end of a 34 minute period of reaction, the flow of the gaseous mixture (8 percent molecular oxygen in nitrogen) was replaced with nitrogen. After the reactor cooled the system was depressured, unsealed, and the oxygenated mixture was identified as GS-25-B288. A sample of oxygenated mixture GS-25-B288 was dried over anhydrous sodium sulfate and analyzed.

Analysis of GS-25-B288 of this example determined a sulfur content of 3 ppm, i.e. a sulfur reduction of 70 percent, oxygenation of 3.8 percent, and a total acid number of 7.4 mg KOH/g.

EXAMPLE 6

For this example the 5 gallon pressure reactor was charged with another portion of S-25-B288 and cobalt(II) octoate in mineral sprits to provide a cobalt concentration of 750 ppm. Oxygenation was carried out as in Example 3, except that the reaction period was extended to 39 minutes. Analysis of oxygenated S-25-B288-1 identified as GS-25-B288-1 determined an oxygenation of 4.18 percent, and a total acid number of 11.8 mg KOH/g.

The procedure of this example was repeated 10 times to obtain by blending a supply of oxygenated product for post-treatment testing. The blend of GS-25-B288-X, numbered 1 to 10 was identified as BGS-25-B288. Each oxidation product GS-25-B288-X consisted of two layers. The top (bulk) layer was decanted from the lower layer, and the top layer used in post-oxidation treatments.

A 4 liter Erlenmeyer flask outfitted with a large magnetic stirring bar was charged with 1 liter of GS-25-B288-X oxidation product. The magnetic stirrer was started and approximately 500 mL of saturated aqueous sodium bicarbonate was carefully added to the flask. Once all of the aqueous base was added, the stirrer was turned up to the maximum rate and the mixture of immiscible phases was permitted to agitate for approximately 20 minutes. At that point, the agitation was ceased, and the mixture was poured into a 2 liter separatory funnel where the two immiscible phases were permitted to separate.

The bottom, aqueous layer was removed and discarded. Treatment with fresh aqueous sodium bicarbonate was repeated as necessary to reduce the level of acidic co-products. This extracted material was transferred to an Erlenmeyer flask and approximately 500 mL of deionized and distilled water added to the flask. After agitation for approximately 10 minutes, the mixture was again poured into a separatory funnel and the layers were permitted to separate. The bottom, aqueous layer was drained and discarded.

For the next step in the post-treatment process an LC-type column measuring 3 inches ID×24 inches in length was filled with approximately three liters of dried 3A molecular sieve. The combined blend from the sodium bicarbonate extractions and wash treatment, BGS-25-B288, was dripped through the column to remove any residual water. This material was identified as E6-F and used for blending in Example 18.

EXAMPLE 7

For this example the 300 mL Parr pressure reactor bottom was charged with S-25 and cobalt(II) bis-acetylacetonate hydrate to provide a cobalt concentration of 543 ppm. Oxygenation of S-25 was carried out as in Example 5, except that the reaction period was 33 minutes. Analysis of oxygenated S-25 in this example determined a sulfur content of 11 ppm, i.e. a sulfur reduction of 45 percent, a nitrogen content of 9 ppm, i.e. a nitrogen reduction of 50 percent, oxygenation of 3.61 percent, and a total acid number of 7.1 mg KOH/g.

EXAMPLES 8-11

Hydrotreated refinery distillate S-25 was partitioned by distillation to provide feedstock for oxidation using hydrogen peroxide and acetic acid. The fraction collected below temperatures of about 300° C. was a sulfur-lean, monoaromatic-rich fraction identified as S-25-B300. Analysis of S-25-B300 determined a sulfur content of 3 ppm, a nitrogen content of 2 ppm, and 36.2 percent mono-aromatics, 1.8 percent di-aromatics, for a total aromatics of 37.9 percent. The fraction collected above temperatures of about 300° C. was a sulfur-rich, monoaromatic-poor fraction identified as S-25-A300. Analysis of S-25-A300 determined a sulfur content of 35 ppm, a nitrogen content of 31 ppm, and aromatic content was 15.7 percent mono-aromatics, 5.8 percent di-aromatics, and 1.4 percent tri-aromatics, for a total aromatics of 22.9 percent.

Into a 250 mL, three-neck round bottom flask equipped with a reflux condenser, a mechanical agitator, a nitrogen inlet and outlet, were charged 100 g of S-25-A300. The reactor was also charged with varying amounts of glacial acetic acid, distilled and deionized water, and 30 percent aqueous hydrogen peroxide. The mixture is heated with stirring and under a slight flow of nitrogen at approximately 93° C. to 99° C. for approximately two hours. At the end of the reaction period, the agitation ceased and the contents of the flask rapidly formed into two liquid layers. A sample of the top layer (organic) was withdrawn and dehydrated with anhydrous sodium sulfate. Contents of the flask was stirred and permitted to cool to ambient temperature before approximately 0.1 g of manganese dioxide is added to decompose any residual hydrogen peroxide. At this point, the mixture was stirred for an additional 10 minutes before the entire reactor content was collected.

Table III gives variables and analytical data which demonstrate that increasing concentration of acetic acid increases concentration of total sulfur in the aqueous layer. Increasing level of acetic acid caused sulfur in the organic layer to decrease by 35 ppm. These data clearly indicate that an essential element of the present of invention is the use of organic peracids where the carbonyl carbon is attached to hydrogen or a hydrocarbon radical. In general such hydrocarbon radical contains from 1 to about 12 carbon atoms, preferably from about 1 to about 8 carbon atoms. Acetic acid was shown to extract oxidized sulfur compounds from the organic phase and into the aqueous phase. Without acetic acid, no noticeable sulfur transfer into the aqueous phase was observed.

TABLE III

EXPERIMENTAL PARAMETERS AND ANALYTICAL RESULTS FOR OXIDATIONS OF LS-25-A300

| | EXAMPLE | | | |
|---|---|---|---|---|
| | 8 | 9 | 10 | 11 |
| $H_2O_2$, mL | 34 | 34 | 34 | 34 |
| HOAc, mL | 0 | 25 | 50 | 75 |
| $H_2O$, mL | 100 | 75 | 50 | 25 |
| Sulfur Aq, ppm | <2 | <2 | 13 | 14 |
| Sulfur Org, ppm | 33 | 30 | 21 | 18 |

$H_2O_2$ is 30 percent hydrogen peroxide.
HOAc is glacial acetic acid.
$H_2O$ is distilled water.

EXAMPLE 12

Hydrotreated refinery distillate S-25 was partitioned by distillation to provide feedstock for oxidation using an immisciable aqueous solution phase containing hydrogen peroxide and acetic acid. The fraction of S-25 collected above temperatures of about 316° C. was a sulfur-rich, monoaromatic-poor fraction identified as S-25-A316. Analysis of S-25-A316 determined a sulfur content of 80 ppm, and a nitrogen content of 102 ppm.

A 250 mL, three-neck round bottom flask equipped with a reflux condenser, a magnetic stir bar or mechanical agitator, a nitrogen inlet and outlet, was charged with 100 g of the S-25-A316, 75 mL glacial acetic acid, 25 mL water, and 17 mL (30%) hydrogen peroxide. The mixture was heated to 100° C. and stirred vigorously under a very slight flow of house nitrogen for two hours.

At the end of the reaction period, analysis of the top layer (organic) found total sulfur and nitrogen of 54 ppm sulfur and 5 ppm nitrogen. Contents of the flask was again stirred and cooled to room temperature. At room temperature, approximately 0.1 g of manganese dioxide ($MnO_2$) was added to decompose any excess hydrogen peroxide and stirring continued for 10 minutes. The entire contents of the flask were then poured into a bottle with a vented cap. Analysis of the bottom layer (aqueous) found 44 ppm of total sulfur.

EXAMPLE 12a

A second oxidation of hydrotreated refinery distillate S-25-A316 was conducted as described in Example 12 by charging 100 mL glacial acetic acid, but no water. The organic layer was found to contain 27 ppm sulfur and 3 ppm nitrogen. The aqueous layer contained 81 ppm sulfur.

EXAMPLE 12b

The entire contents of the flask from both Example 12 and Example 12a were combined. A bottom layer was then removed, leaving behind a combined organic layer from both experiments. The organic layer was dried over anhydrous sodium sulfate to remove any residual water from the process. After the spent sodium sulfate was removed via vacuum filtration, the filtrate was percolated through enough alumina so that the filtrate to alumina ratio ranged from 7:1 to 10:1. Analysis of organic layer emerging from the alumina was 32 ppm of total sulfur and 5 ppm of total nitrogen.

EXAMPLE 13

A hydrotreated refinery distillate identified as S-150 was partitioned by distillation to provide feedstock for oxidations using peracid formed with hydrogen peroxide and acetic acid. Analysis of S-150 determined a sulfur content of 113 ppm, and a nitrogen content of 36 ppm. The fraction of S-150 collected above temperatures of about 316° C. was a sulfur-rich, monoaromatic-poor fraction identified as S-150-A316. Analysis of S-150-A316 determined a sulfur content of 580 ppm and a nitrogen content of 147 ppm.

A 3 liter, three neck, round bottom flask equipped with a water-jacketed reflux condenser, a mechanical stirrer, a nitrogen inlet and outlet, and a heating mantel controlled through a variac, was charged with 1 kg of S-150-A316, 1 liter of glacial acetic acid and 170 mL of 30 percent hydrogen peroxide.

A slight flow of nitrogen was initiated and this gas then slowly swept over the surface of the reactor content. The agitator was started to provide efficient mixing and the contents were heated. Once the temperature reaches 93° C., the contents were held at this temperature for reaction time of 120 minutes.

After the reaction time had elapsed, the contents continued to be stirred while the heating mantel turned off and removed. At approximately 77° C., the agitator was stopped momentarily while approximately 1 g of manganese dioxide ($MnO_2$) was added through one of the necks of the round bottom flask to the biphasic mixture to decompose any unreacted hydrogen peroxide. Mixing of the contents with the agitator was then resumed until the temperature of the mixture was cooled to approximately 49° C. The agitation was ceased to allow both organic (top) and aqueous (bottom) layers to separate, which occurred immediately.

The bottom layer was removed and retained for further analysis in a lightly capped bottle to permit the possible evolution of oxygen from any undecomposed hydrogen peroxide. Analysis of the bottom layer was 252 ppm of sulfur.

The reactor was cautiously charged with 500 mL of saturated aqueous sodium bicarbonate to neutralize the organic layer. After the bicarbonate solution was added, the mixture was stirred rapidly for ten minutes to neutralize any remaining acetic acid. The organic material was dried over anhydrous 3A molecular sieve. Analysis of the dry organic layer, identified as PS-150-A316, was 143 ppm of sulfur, 4 ppm of nitrogen, and a total acid number of 0.1 mg KOH/g.

EXAMPLE 14

A 500 mL separatory funnel was charged with 150 mL of PS-150-A316 and 150 mL of methanol. The funnel was shaken and then the mixture was allowed to separate. The bottom methanol layer was collected and saved for analytical testing. A 50 mL portion of the product was then collected for analytical testing and identified as sample ME14-1.

A 100 mL portion of fresh methanol was added to the funnel containing the remaining 100 mL of product. The funnel was again shaken and the mixture was allowed to separate. The bottom methanol layer was collected and saved for Analytical testing. A 50 mL portion of the methanol extracted product was collected for analytical testing and identified as sample ME14-2.

Into the remaining 50 mL of product in the funnel, 50 mL of fresh methanol was added. The funnel was again shaken and the two layers were allowed to separate. The bottom methanol layer was collected and saved for analytical testing. 50 mL of the product is collected for analytical testing and identified as sample ME14-3.

The Analytical results obtained for this example are shown in Table IV.

TABLE IV

REDUCTION OF SULFUR & TOTAL ACID NUMBER BY METHANOL EXTRACTIONS

| Sample | TAN, mg KOH/g | Sulfur, ppmw |
|---|---|---|
| PS-150-A316 | 0.11 | 143 |
| ME14-1 | 0.02 | 35 |
| ME14-2 | 0.02 | 14 |
| ME14-3 | 0.02 | 7 |

These results clearly show that methanol was capable of selectively removing oxidized sulfur compounds. Additionally, acidic impurities were also removed by methanol extraction.

EXAMPLE 15

A separatory funnel was charged with 50 mL of PS-150-A316 and 50 mL water. The funnel was shaken and the layers were allowed to separate. The bottom water layer was collected and saved for analytical testing. The hydrocarbon layer was collected for analytical testing and identified as E15-1W. Table V presents these results.

TABLE V

REDUCTION OF SULFUR BY WATER EXTRACTION

| Sample | TAN mg KOH/g | Nitrogen ppmw | Sulfur ppmw |
|---|---|---|---|
| PS-150-A316 | 0.11 | 4 | 143 |
| E15-1W | — | 5 | 100 |

The water extraction results show that water was useful in removing oxidized sulfur compounds from the distillate.

EXAMPLE 16

Five hundred grams of PS-150-A316 were percolated through 50 grams of anhydrous acidic alumina. The collected product was identified as E16-1A and analyzed. The data are presented in Table VI.

TABLE VI

REDUCTION OF SULFER AND NITROGEN BY ALUMINA TREATMENT

| Sample | Nitrogen ppmw | Sulfur ppmw |
|---|---|---|
| PS-150-A316 | 4 | 143 |
| E16-1A | 2 | 32 |

These data demonstrate that alumina treatment was also effective in the removal of oxidized sulfur and nitrogen compounds from the distillate.

Analysis was conducted on alumina treated material E16-1A and compared with the PS-150-A316. The analysis showed an absence of any dibenzothiophene in the products, while the feed contained about 3,000 ppm of this impurity.

EXAMPLE 17

Hydrotreated refinery distillate S-25 was partitioned by distillation to provide a feedstock for oxidations using peracid formed with hydrogen peroxide and acetic acid. The fraction of S-25 collected below temperatures of about 288° C. was a sulfur-lean, monoaromatic-rich fraction identified as S-DF-B288. The fraction of S-25 collected above temperatures of about 288° C. was a sulfur-rich, monoaromatic-poor fraction identified as S-DF-A288. Analysis of S-DF-A288 determined a sulfur content of 30 ppm.

A series of oxidation runs were conducted as described in Example 13 and the products combined to provide amounts of material needed for cetane rating and chemical analysis. A flask equipped as in Example 13 was charged with 1 kg of S-DF-A288, 1 liter of glacial acetic acid, 85 mL of deionized and distilled water and 85 mL of 30 percent hydrogen peroxide.

In one procedure a batch of dried oxidized distillate was percolated through a second column packed with 250 mL of dried, acidic alumina (150 mesh). The distillate to alumina ratio was about 4:1 (v/v). The alumina was used for approximately 4 batches of 1,000 mL, and replaced.

In another procedure approximately 100 grams of alumina was placed in a 600 mL Büchner funnel equipped with a fritted disc (fine). Dried distillate was poured over the alumina and more quickly treated as the vacuum draws the distillate through the alumina in a shorter time.

Every batch of post-alumina treated material was submitted for total sulfur analysis to quantify the sulfur removal efficiency from the feed. All alumina treated materials had a sulfur concentration of less than 3 ppmw, and in general about 1 ppmw sulfur. A blend of 32 batches of alumina treated material was identified as BA-DF-A288.

EXAMPLE 18

Alumina treated materials BA-DF-A288 from Example 17 and oxygenated material E6-F from Example 6 were blended to produce fuel DF-GP. Results of testing and analysis of fuel DF-GP are presented in Table VII.

TABLE VII

Fuel Blended from Oxygenated Low-Boiling and Oxidative Desulfurized High-Boiling Fractions and Alumina Treatment

| Analysis | Fuel DF-GP | S-25 |
|---|---|---|
| Total Acid Number mg KOH/g | 1.2 | <0.01 |
| Sulfur, ppmw | <1 | 20 |
| Nitrogen, ppmw | 1.5 | 13 |
| Cetane Number | 56 | 50 |
| Spec. Gravity @ 16° C. | 0.86 | 0.84 |
| Heat of Combustion (Btu/gal) | 137,820 | 137,450 |
| Oxygenation, Percent | 1.99 | |

EXAMPLE 19

Another portion of S-25-B288 was oxygenated by the method described in Example 5. For this example, the 300 mL Parr pressure reactor bottom was charged with S-25-B288 (125 g) and cobalt(II) bis-acetylacetonate hydrate (0.41 g). A sample of oxygenated mixture, identified as GS-25-B288a, was dried over anhydrous sodium sulfate and analyzed. Analysis of GS-25-B288a determined a sulfur content of 4 ppm, and oxygenation of 3.52 percent.

EXAMPLE 20

The procedure of Example 19 was repeated twice, except that cobalt (II) octanoate/2-ethylhexanoate was the source of cobalt (6 percent by weight of cobalt in mineral spirits). The weight of catalyst solution charged was 0.78 grams. Analysis of oxygenated material produced by the first repeat run determined a sulfur content of 3 ppm, and oxygenation of 3.58 percent, and for the second repeat run a sulfur content of 2 ppm, and oxygenation of 3.44 percent.

EXAMPLE 21

Oxygenated materials GS-25-B288, GS-25-B288a, and materials of both repeat runs of Example 20 were combined, and the combined material identified as composite GS-21. Analysis of this composition determined a total oxygenation level of 1.56 percent. Distribution of oxygen in GS-21 according to the preferred classes of aryl structures is presented in Table VIII, wherein R is hydrogen or a hydrocarbon radical containing from 1 to about 10 carbon atoms.

TABLE VIII

| Aryl Oxygenates | Oxygen, Percent by Weight of GS-21 |
|---|---|
| Type I | 0.57 |
| Type II | 0.31 |
| Type III | 0.31 |
| Type IV | 0.17 |
| Type V | 0.11 |
| Type VI | 0.06 |
| Type VII | 0.02 |
| Type VIII | 0.01 |

EXAMPLE 22

This experiment describes treatment of composite GS-21 for blending with an oxidatively desulfurized distillate fraction. Using a separatory funnel, 396.98 grams of GS-21 was extracted with three 200 mL portions of saturated, aqueous sodium bicarbonate. The aqueous sodium bicarbonate washes were discarded. The organic (top) layer was then washed with three 200 mL of distilled and deionized water. The water washes were discarded. The organic material was then centrifuged to remove any remaining water. The washed GS-21 material was then dried over anhydrous 3 A molecular sieve. Treated GS-21 was separated from the sieve by filtration (Millipore, Type LC, 10 micron). Analytical results are presented in Table IX.

TABLE IX

| Analysis | Results |
|---|---|
| Total Acid Number (mg KOH/g) | 1.25 |
| Cobalt (ppmw) | <0.6 |
| Total Nitrogen (ppmw) | 5 |
| Total Sulfur (ppmw) | 1 |

EXAMPLE 23

Into a three liter, three-neck round bottom flask equipped with a reflux condenser, a mechanical agitator, a nitrogen inlet and outlet, were charged 814 g of S-25-A288. The reactor was also charged with 770 mL of glacial acetic acid and 170 mL 30 percent aqueous hydrogen peroxide. The mixture was heated with stirring and under a slight flow of nitrogen at approximately 93° C. for approximately two hours. After the reaction period, the flask and contents were cooled, and during the cooling period approximately 1 g of manganese dioxide ($MnO_2$) was added to the round bottom flask to decompose any unreacted hydrogen peroxide. When the agitation ceased, the contents of the flask rapidly formed into two liquid layers. The aqueous (bottom) layer was removed from the flask. The organic layer was treated with 500 mL of saturated aqueous sodium bicarbonate solution. Again the aqueous (bottom) layer was removed from the flask. The washed material was then dried over anhydrous 3 A molecular sieve, separated from the sieve by filtration, and identified as PS-23.

EXAMPLE 24

This experiment describes treatment of PS-23 for blending with treated GS-21. Using a separatory funnel, 680 grams of PS-23 was treated with 680 grams of methanol. The mixture was shaken for one minute and the two layers were permitted to separate. The bottom layer (product layer) was collected and the top (methanol) layer was discarded. The product layer was treated two more times with 680 gram portions of methanol. Each time, the methanol layer was discarded.

The methanol treated product was further treated with an equal portion by weight of deionized and distilled water in a separatory funnel. The mixture was shaken for approximately one minute to wash the product. The mixture was permitted to separate into two layers. The bottom, water layer was drained and discarded. A centrifuge was employed to remove the residual amount of water remaining in the organic layer. This oxidatively desulfurized material was identified as PS-24 and submitted for analysis. Analytical results are presented in Table X.

TABLE X

| Analysis | Results |
|---|---|
| Total Acid Number (mg KOH/g) | <0.01 |
| Total Nitrogen (ppmw) | 2 |
| Total Sulfur (ppmw) | 1 |
| Methanol (ppmw) | 63.3 |
| Density (g/mL) | 0.849 |

EXAMPLE 25

A composition was blended using 7 parts by weight of treated GS-21 to 3 parts by weight oxidatively desulfurized material PS-24 which produced the desired oxygenated, ultralow sulfur composition. Analysis of this composition determined an oxygenation of 1.82 percent.

For the purposes of the present invention, "predominantly" is defined as more than about fifty percent. "Effective amount" is defined being present in such proportions as to produce a decided, decisive, or desired measurably affect macroscopic properties of an associated compound or system. "Substantially" is defined as occurring with sufficient frequency or being present in such proportions as to measurably affect macroscopic properties of an associated compound or system. Where the frequency or proportion for such impact is not clear, substantially is to be regarded as about twenty percent or more. The term "essentially" is defined as absolutely except that small variations which have no more than a negligible effect on macroscopic qualities and final outcome are permitted, typically up to about one percent.

That which is claimed is:

1. A fuel for use in compression ignition internal combustion engines, comprising: as a predominant component organic distillates derived from natural petroleum, and one or more oxygen-containing organic compounds selected from the group consisting of aryl oxygenates of type II and type III Type II

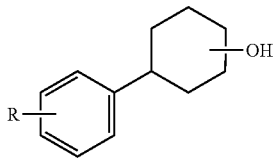

Type III

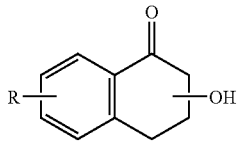

in amounts such that the oxygen content of the fuel is in a range from about 0.2 percent to about 10 percent oxygen, where R is hydrogen or a hydrocarbon radical containing from 1 to about 10 carbon atoms, and wherein a source of the aryl oxygenates is the composition formed by a process which comprises:

partitioning by distillation an organic feedstock comprising a mixture of organic compounds derived from natural petroleum, the mixture having a gravity ranging from about 10° API to about 75° API to provide at least one low-boiling organic part consisting of a sulfur-lean, mono-aromatic-rich fraction, and a high-boiling organic part consisting of a sulfur-rich, mono-aromatic-lean fraction;

contacting a gaseous source of dioxygen with at least a portion of the low-boiling organic part in a liquid reaction medium containing a soluble catalyst system comprising a source of at least one catalyst metal selected from the group consisting of manganese, cobalt, nickel, chromium, vanadium, molybdenum, tungsten, tin, cerium, and a mixture thereof, while maintaining the liquid reaction medium substantially free of halogen and/or halogen-containing compounds, to form a mixture of immiscible phases comprising hydrocarbons, oxygenated organic compounds, water of reaction, and a acidic co-products;

separating from the mixture of immiscible phases at least a first organic liquid of low density comprising hydrocarbons, oxygenated organic compounds and first acidic co-products and a second liquid of high density which contains at least portions of the catalyst metal, water of reaction and second acidic co-products; and contacting all or a portion of the separated organic liquid with a neutralizing agent thereby recovering a low-boiling oxygenated product having a low content of acidic co-products.

2. A composition for fuel or blending component for fuels which are liquid at ambient conditions, which composition comprises: as a predominant component organic distillates which contain less than 15 ppm sulfur, and oxygen-containing organic compounds derived from natural petroleum in amounts such that the oxygen content of the fuel is in a range from about 0.2 percent to about 10 percent oxygen, with the proviso that at least 10 percent of the oxygen is contained in cyclic benzylic ketones, represented by

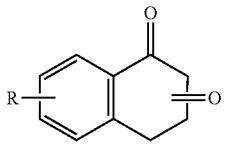

where R is hydrogen or a hydrocarbon radical comprising from 1 to 10 carbon atoms.

3. The composition according to claim 2 further comprising an effective amount of one or more fuel additives which enhance desired fuel properties.

4. A fuel for use in compression ignition internal combustion engines, comprising: as a predominant component organic distillates, which contain less than 15 ppm sulfur, and one or more oxygen-containing organic compounds derived from natural petroleum in amounts such that the oxygen content of the fuel is in a range from about 0.2 percent to about 10 percent oxygen, with the proviso that at least 5 percent of the oxygen is contained in cyclic benzylic diketones represented by

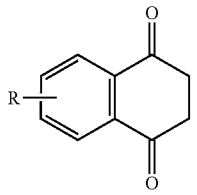

where R is hydrogen or a hydrocarbon radical comprising from 1 to 10 carbon atoms and wherein the fuel exhibits a suitable flash point of at least 38° C. as measured by ASTM D93.

5. The composition according to claim 4 wherein the fuel exhibits a suitable flash point of at least 49° C.

6. The composition according to claim 4 further comprising an effective amount of one or more Diesel fuel additives selected from the group consisting of copolymers of ethylene and vinyl acetate, which enhances cold flow properties of Diesel fuel.

* * * * *